United States Patent [19]

Hashimoto

[11] Patent Number: 4,972,808

[45] Date of Patent: Nov. 27, 1990

[54] ARRANGEMENT OF COOLING SYSTEM FOR TRANSVERSELY MOUNTED INTERNAL COMBUSTION ENGINE

[75] Inventor: Hiroshi Hashimoto, Chigasaki, Japan

[73] Assignee: Nissan Motor Co., Ltd., Yokohama, Japan

[21] Appl. No.: 498,244

[22] Filed: Mar. 14, 1990

[30] Foreign Application Priority Data

Apr. 3, 1989 [JP] Japan ..... 1-81566
May 1, 1989 [JP] Japan ..... 1-112566

[51] Int. Cl.[5] ..... F01P 3/02
[52] U.S. Cl. ..... 123/41.1; 123/55 VS
[58] Field of Search ..... 123/41.08, 41.09, 41.1, 123/55 VF, 55 VS, 55 VE

[56] References Cited

U.S. PATENT DOCUMENTS 4,369,738 1/1983 Hiroyama ..... 123/41.1

FOREIGN PATENT DOCUMENTS 125516 5/1989 Japan ..... 123/55 VS

*Primary Examiner*—Noah P. Kamen
*Attorney, Agent, or Firm*—Pennie & Edmonds

[57] ABSTRACT

An arrangement of cooling system for transversely mounted internal combustion engine is disclosed, which is compactly mounted in an engine room. The arrangement comprises a water pump driven by the engine to force the cooling water drawn thereto to flow into a water jacket of the engine, the water pump being positioned at one longitudinal end of the engine; a thermostat assembly positioned at the other longitudinal end of the engine; a suction passage for transferring cooling water from the thermostat assembly to the water pump; a first structure defining a first water outlet of the water jacket at a position near the water pump; a second structure defining a second water outlet of the water jacket at a position near the thermostat assembly; a bypass passage extending between the second water outlet and the thermostat assembly; a radiator located beside the engine and having inlet and outlet openings; an inlet hose connecting the first water outlet to the inlet opening; and an outlet hose connecting the outlet opening of the radiator to the thermostat assembly.

15 Claims, 13 Drawing Sheets

ARRANGEMENT OF COOLING SYSTEM FOR TRANSVERSELY MOUNTED INTERNAL COMBUSTION ENGINE

BACKGROUND OF THE INVENTION

1. Field of the Invention

The present invention relates in general to water cooling type cooling systems for internal combustion engines, and more particularly, to an arrangement of the cooling system, which suits with a transversely mounted internal combustion engine.

2. Description of the Prior Art

In order to clarify the task of the present invention, one conventional arrangement of water cooling type cooling system for a transversely mounted internal combustion engine (which will be referred to as transverse engine hereinafter) will be outlined with reference to FIG. 14 of the accompanying drawings. The conventional arrangement is disclosed in Japanese Utility Model First Provisional Publication No. 62-69026.

As is shown in FIG. 14, the arrangement is applied to a V-type internal combustion engine which has a pair of banks angled, each bank having three aligned engine cylinders.

Cooling water pumped out by a water pump 1 is introduced into a water jacket of each bank from one longitudinal end of the bank. After cooling the engine cylinders of each bank, the cooling water is discharged from the water jacket from the other longitudinal end of the bank. When, due to a warm up condition of the engine, a thermostat 2 closes an outlet hose **4*b* for a radiator 3 while opening a bypass passage 5, the cooling water from the water jackets of both banks is forced to flow through the bypass passage 5 and a suction passage 6 and return to the water pump 1 in a manner as is indicated by shorter arrows. While, when, upon completion of the engine warm up, the thermostat 2 opens the radiator outlet hose 4*b* while closing the bypass passage 5, the cooling water from the water jackets is forced to flow through a radiator inlet hose 4*a*, the radiator 3, the radiator outlet hose 4*b* and the suction passage 6 and return to the water pump 1** in a manner as is indicated by the longer arrows.

Designated by "Va" and "Vb" are valves which are installed in their associated passages. Thus, when the valves "Va" and "Vb" are opened, the cooling water flows in a manner as is indicated by the dotted line arrows.

The water outlet opening of one bank to which the radiator inlet hose **4*a* is connected is designated by "WO", and the water inlet opening of the thermostat 2 to which the radiator outlet passage 4*b*** is connected is designated by "WI" in the drawing.

However, the above-mentioned arrangement of cooling system becomes to have a drawback particularly when it is applied to a transverse engine.

That is, because the water outlet opening "WO" of the water jackets is located near the water inlet opening "WI" of the thermostat 2, at least one (viz., the inlet hose **4*a* in the illustrated example) of the inlet and outlet hoses 4*a* and 4*b* for the radiator 3 is complicatedly curved. In fact, the inlet hose 4*a* leading from the water outlet opening "WO" extends in one direction (viz., rightward in FIG. 14) and turns back to extend in the other direction (viz., leftward) and then turns toward the radiator 3 for connection with the same. These turnings of the inlet hose 4*a* however cause not a very lengthy structure of the hose 4*a* but also a tangled and jammed arrangement of the hoses 4*a* and 4*b***.

If the thermostat 2 is positioned at the end where the water pump 1 is arranged, the abovementioned drawback may be eliminated. That is, in this case, the inlet hose **4*a* and the outlet hose 4*b* for the radiator 3 are allowed to extend from the longitudinally opposed ends of the engine toward the radiator 3 without making undesired tangled portions thereof. However, usually, the transverse engine has near the water pump 1 no space for mounting such thermostat 5 because when the engine is transversely mounted in an engine room a vehicle, a bulky suspension device is positioned just above the water pump 1**.

SUMMARY OF THE INVENTION

It is therefore an object of the present invention to provide an improved arrangement of cooling system for a transverse internal combustion engine, which is free of the above-mentioned drawbacks.

According to the present invention, there is provided, in an internal combustion engine having a water jacket through which cooling water flows to cool the engine, an arrangment of cooling system for the engine. The arrangment comprises a water pump driven by the engine to force the cooling water drawn thereto to flow into the water jacket, the water pump being positioned at one longitudinal end of the engine; a thermostat assembly positioned at the other longitudinal end of the engine; a suction passage for transferring the cooling water from the thermostat assembly to the water pump; first means defining a first water outlet of the water jacket at a position near the water pump; second means defining a second water outlet of the water jacket at a position near the thermostat assembly; a bypass passage extending between the second water outlet and the thermostat assembly; a radiator located beside the engine and having inlet and outlet openings; an inlet hose connecting the first water outlet to the inlet opening; and an outlet hose connecting the outlet opening of the radiator to the thermostat assembly.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the terms "right", "left" and the like are to be understood with respect to a driver who normally sits in a motor vehicle on which the cooling system arrangement of the invention is properly mounted.

Referring to FIGS. 1 to 11, there is shown an arrangement of water cooling type cooling system for a V-type internal combustion engine, which arrangement is made in accordance with the present invention.

Figure 1:
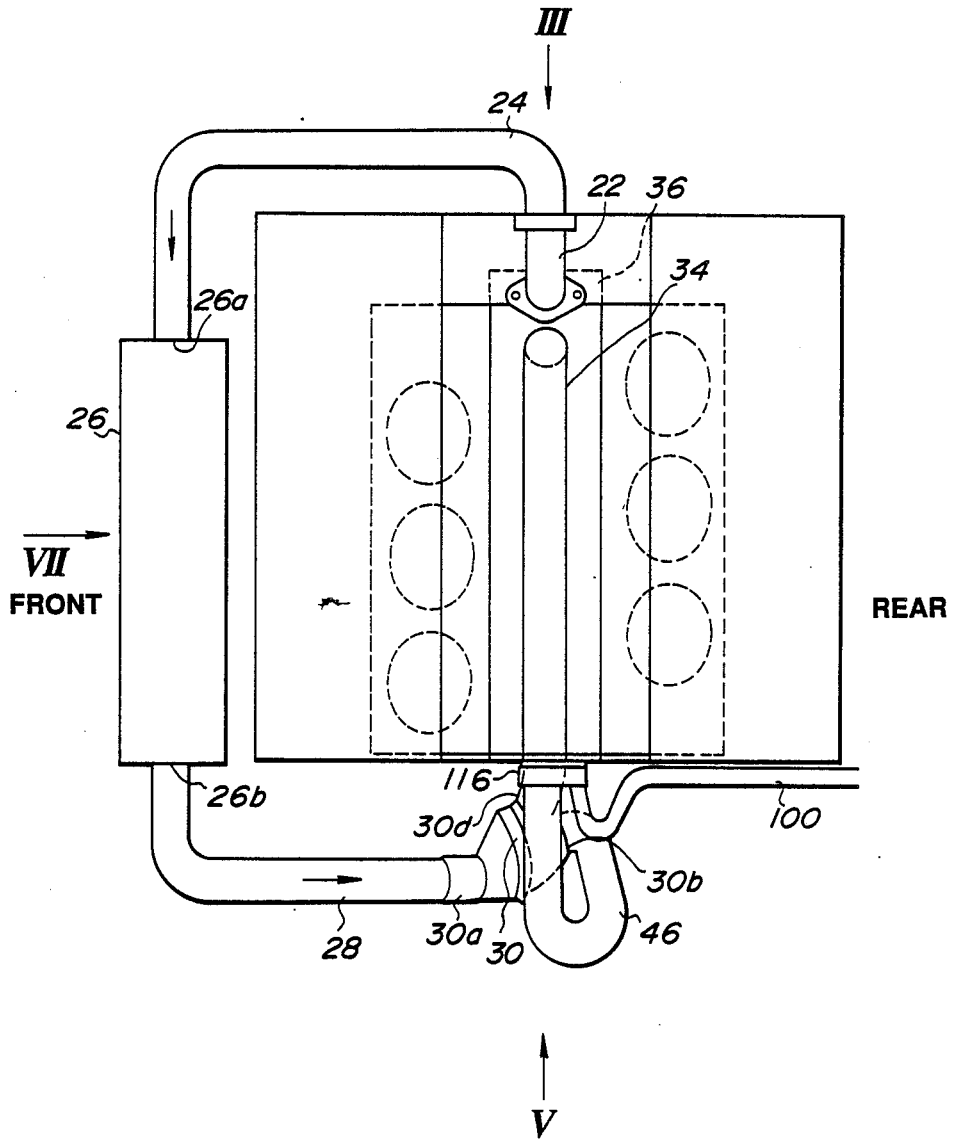
FIG. 1 is a schematic plan view of a V-type 6 cylinder internal combustion engine, to which an arrangement of cooling system of the present invention is applied.
Figure 2:
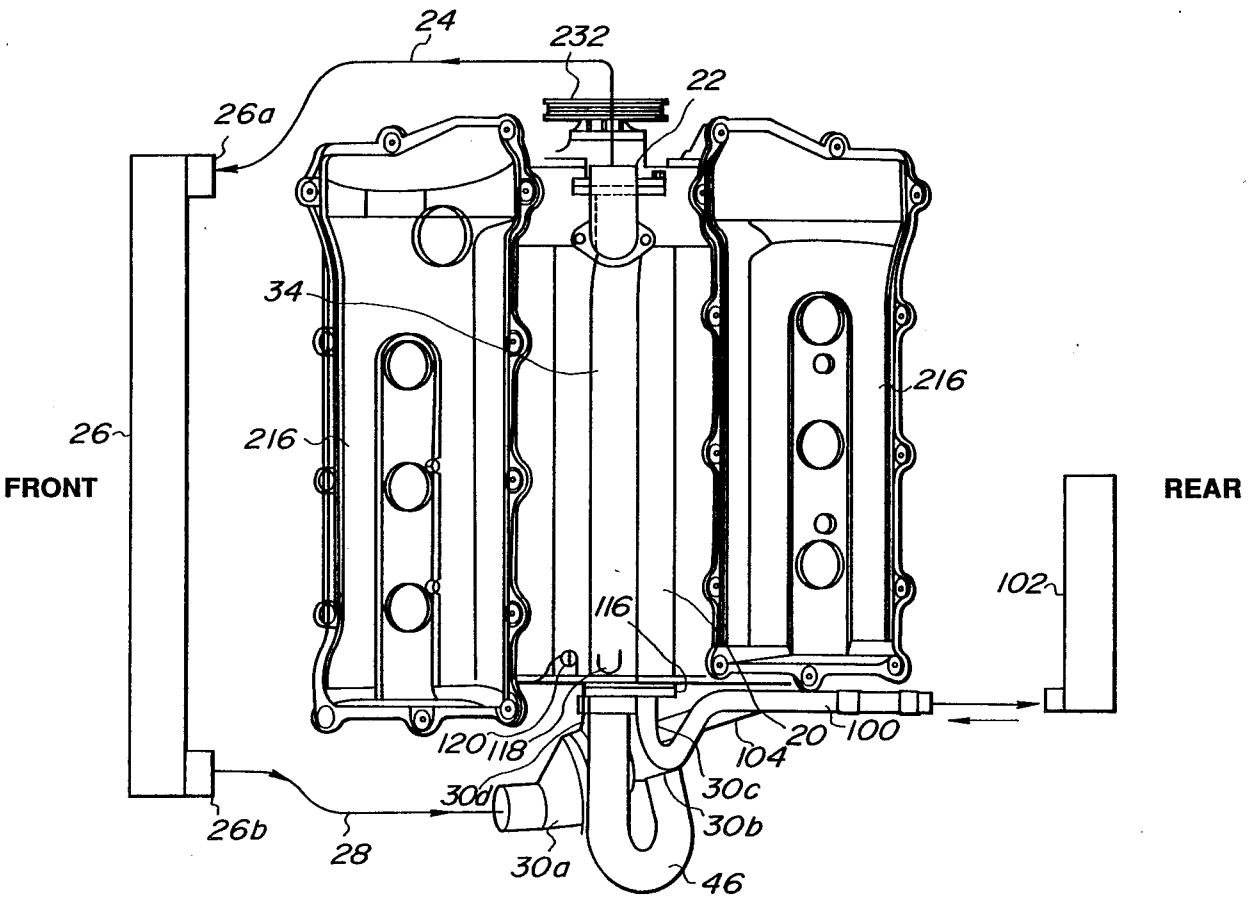
FIG. 2 is a view similar to FIG. 1, but showing some parts illustrated in detail.

As is understood from FIGS. 1 and 2, the engine shown is of a V-type 6 cylinder engine. The engine is transversely mounted in an engine room having a radiator 26 located in front of the engine.

Figure 6:
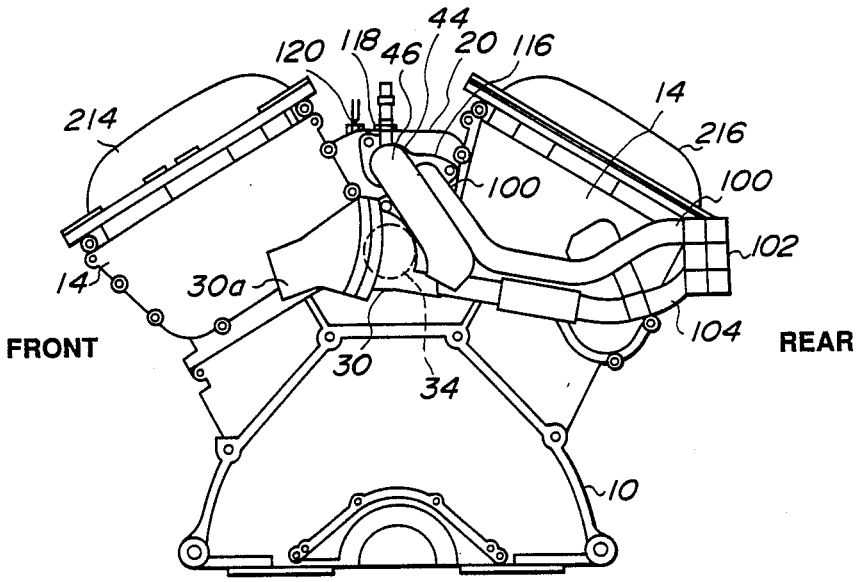
FIG. 6 is a detailed view of FIG. 5, but some parts being removed.
Figure 7:
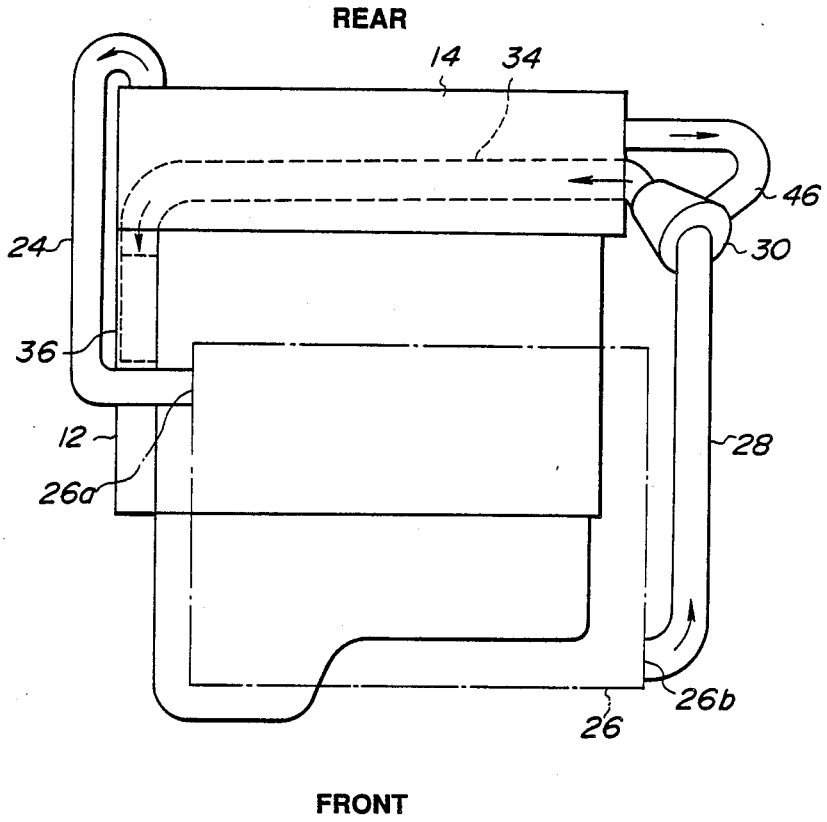
FIG. 7 is a schematic front view taken from the direction of arrow "VII" of FIG. 1.
Figure 9:
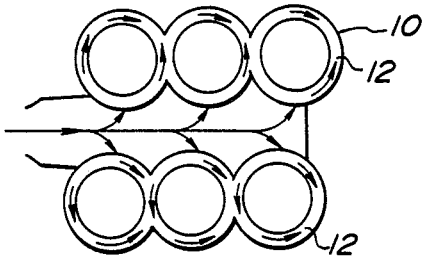
FIG. 9 is a schematic view showing water jackets of the V-type engine, which surround engine cylinders.

As is seen from FIGS. 6 and 9, paired banks on a cylinder block 10 have each a water jacket 12 which surrounds three engine cylinders. A cylinder head 14 on each bank has also a water jacket 16 (see FIG. 10) which surround three combustion chambers. The water jacket 16 of each cylinder head 14 is connected with the water jacket 12 of the corresponding bank in a known manner, as will be seen from FIG. 10.

Each cylinder head 14 has at one longitudinal end a first water outlet opening and at the other longitudinal end a second water outlet opening.

As will become apparent as the description proceeds, the first water outlet openings of the cylinder heads 14 are joined with a first connecting passage (21) which is formed in a right end portion of an intake manifold 20, and the second water outlet openings of the cylinder heads 14 are joined with a second connecting passage 42 which is formed in a left end portion of the intake manifold 20.

As is seen from FIG. 2, the intake manifold 20 is disposed between the two cylinder heads 14. As is seen from FIG. 13, the first connecting passage (21) of the intake manifold 20 has an opening 21 exposed to the outside. A hose connector 22 is connected to the opening 21.

As is seen from FIGS. 1 and 2, when the engine is properly (or transversely) mounted in an engine room, the hose connector 22 is positioned at a right side of the engine room. An inlet hose 24 is connected to the hose connector 22 and leads to an inlet opening 26*a* of a radiator 26. The inlet opening 26*a* is provided at a right end of the radiator 26, which is exposed to an upper tank 26′ of the radiator 26 (see FIG. 5).

As shown, the radiator 26 is arranged in front of the engine having its major face directed forward with respect to the associated motor vehicle. The radiator 26 has at a left end an outlet opening 26*b* from which an outlet hose 28 extends to a first hose connector 30*a* of a thermostat housing 30 which is located at a left end of the engine. The outlet opening 26*b* is exposed to a lower tank 26″ of the radiator 26 (see FIG. 5).

Figure 13:
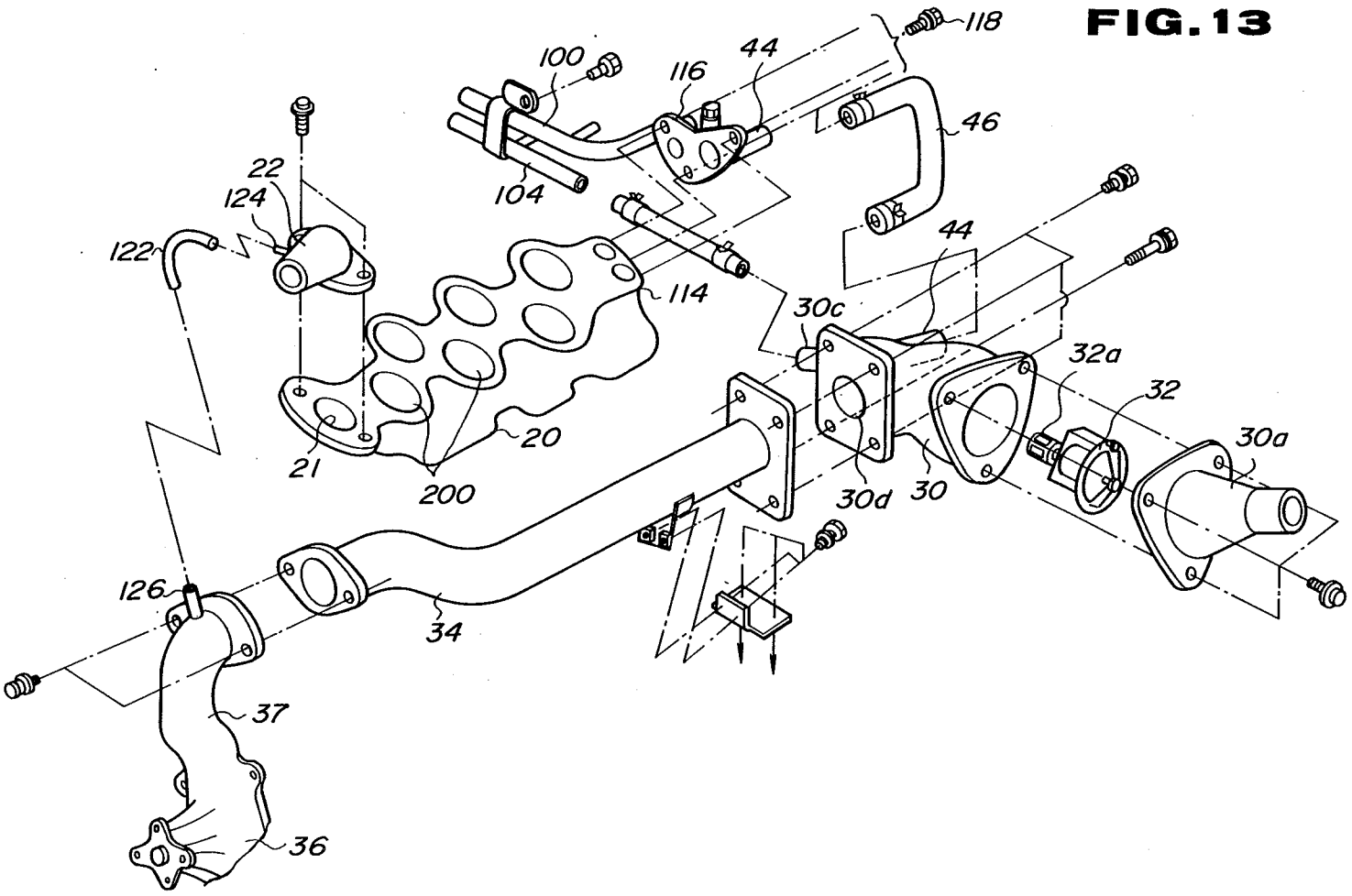
FIG. 13 is an exploded view of various parts of the cooling system, which are to be assembled at a position near an intake manifold.
Figure 14:
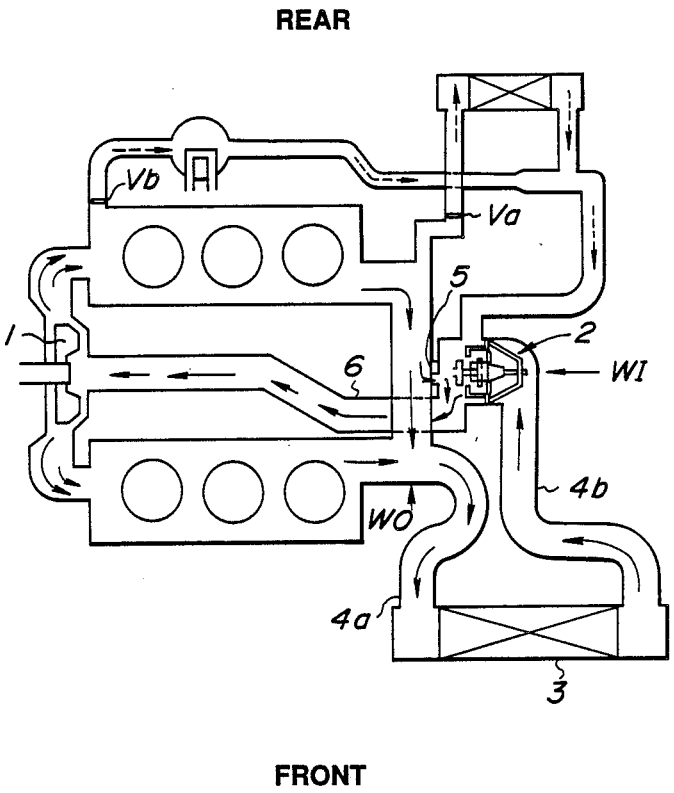
FIG.14 (PRIOR ART)
FIG. 14 is a schematic view showing a conventional arrangement of water cooling type cooling system for a V-type internal combustion engine.

As is seen from FIG. 13, the thermostat housing 30 houses therein a thermostat 32. A suction pipe 34 extends from an outlet opening 30*d* of the thermostat housing 30 through the engine to an intake port of a water pump 36 which is positioned at a right end of the engine. The water pump 36 has a pump housing 37 in which the intake port is defined.

The thermostat housing 30 has further second and third hose connectors 30*b* and 30*c* for the reasons which will become apparent hereinafter.

Figure 4:
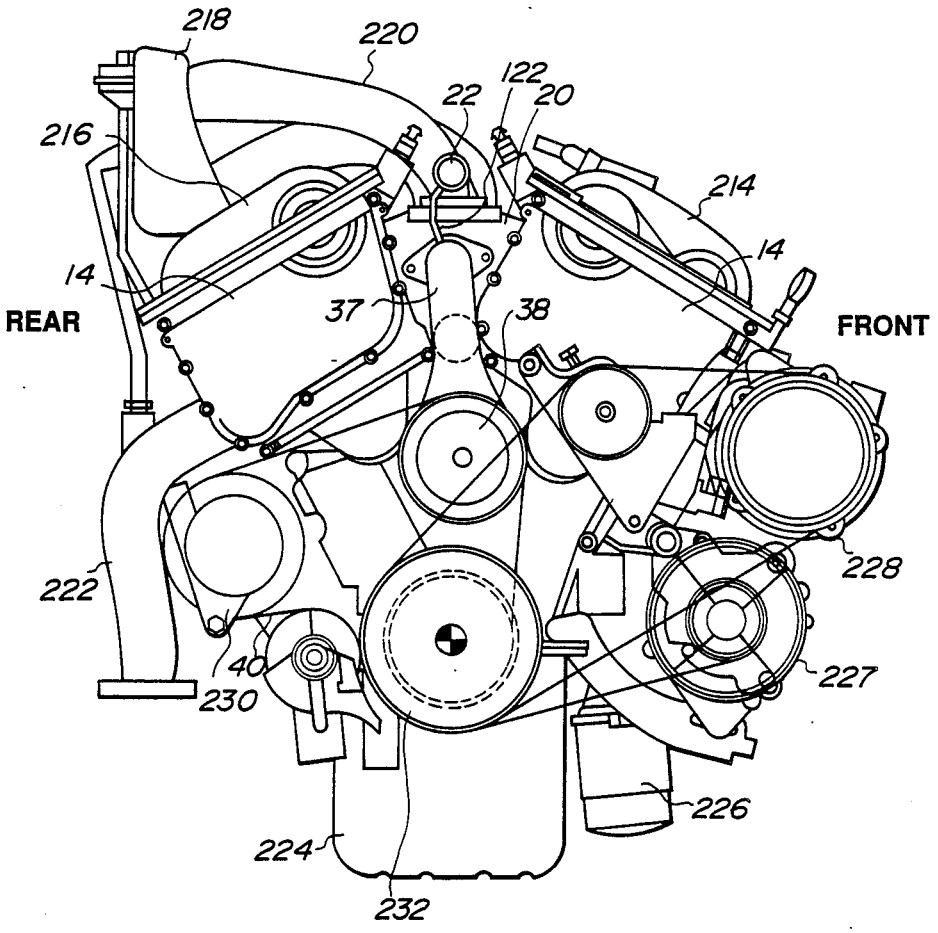
FIG. 4 is a detailed view of FIG. 3.
Figure 8:
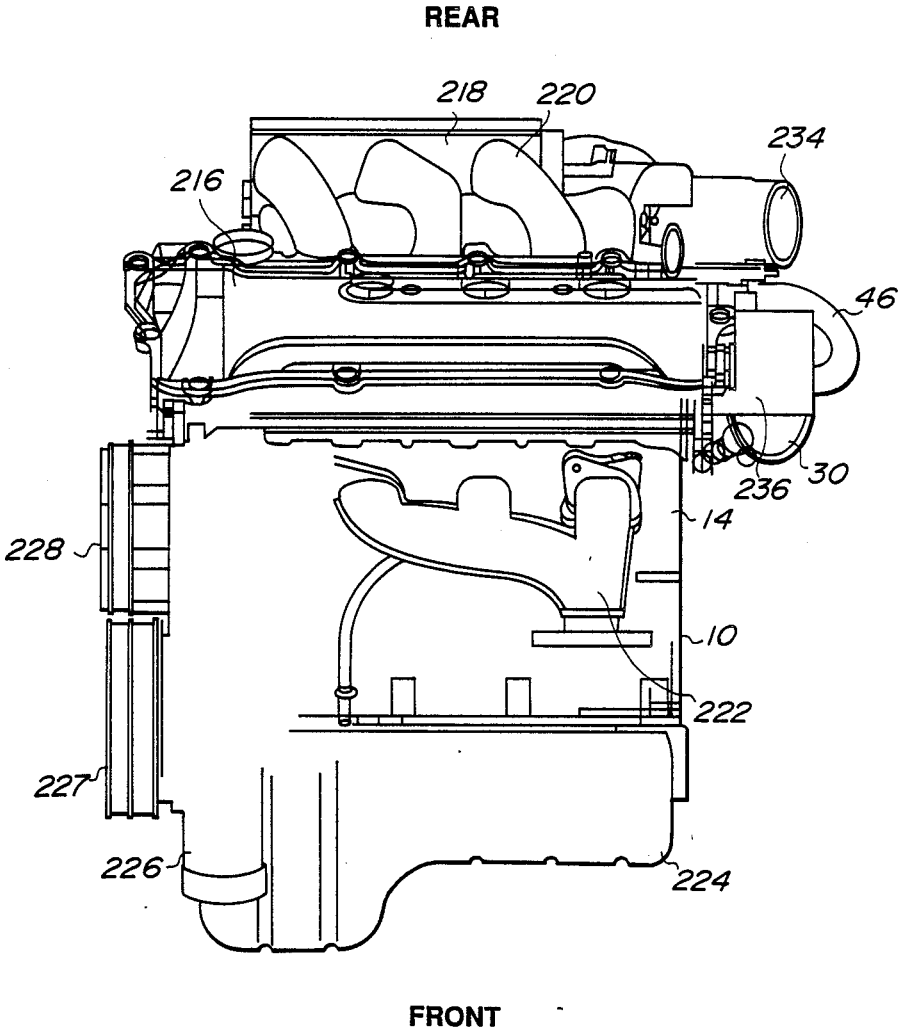
FIG. 8 is a detailed view of FIG. 7, but some parts being removed.

As will be understood from FIG. 4, the water pump 36 has a drive shaft driven by a pulley 38 which is, in turn, driven by a crankshaft of the engine through a belt 40. Denoted by numerals 214 and 216 are rocker covers. Denoted by numeral 218 is a holding structure for branches 220 of the intake manifold 20. Denoted by numerals 222, 224 and 226 are an exhaust manifold, an oil pan and an oil filter, respectively. Denoted by numerals 227, 228, 230 and 232 are an alternator, an air compressor, a power steering pump and a crank pulley, respectively. A throttle valve chamber 234 and a crank angle sensor housing 236 are shown in FIG. 8.

Figure 3:
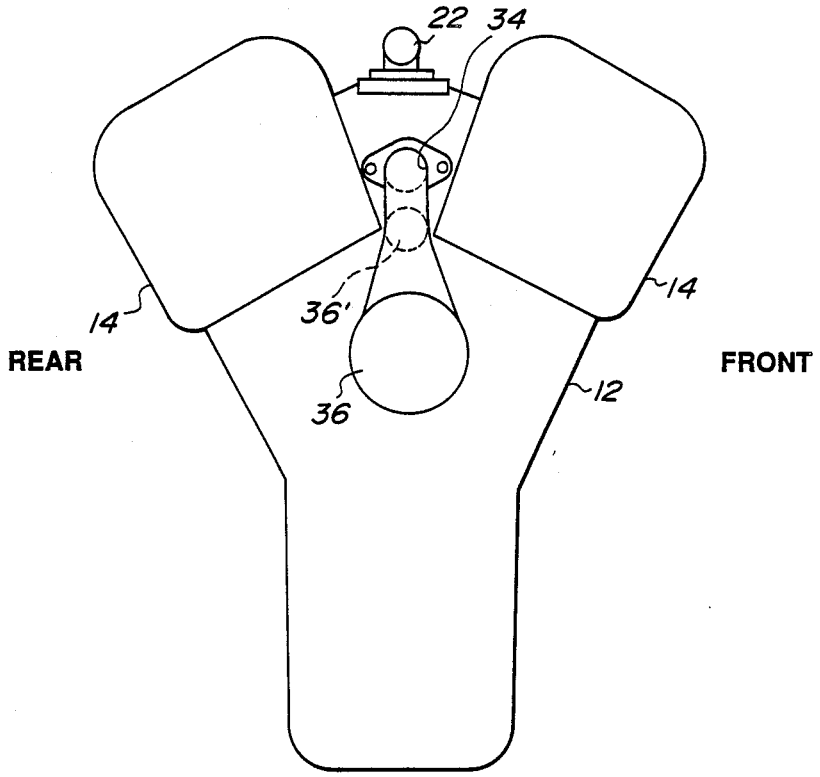
FIG. 3 is a schematic left side view taken from the direction of arrow "III" of FIG. 1.
Figure 10:
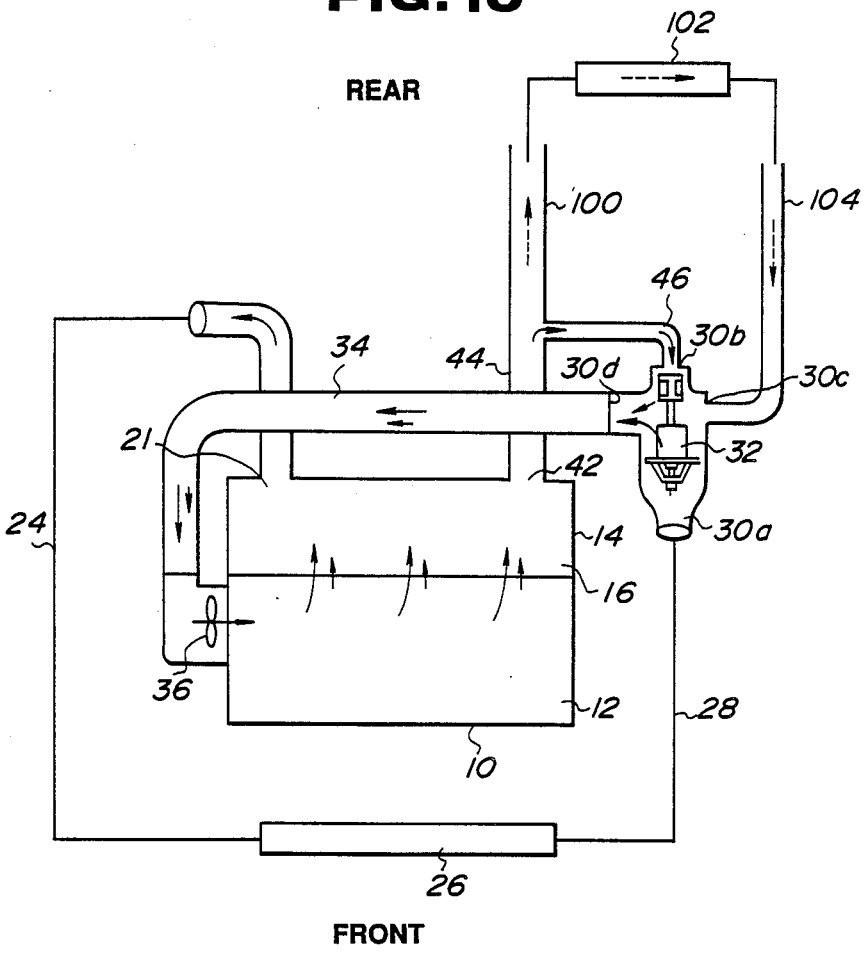
FIG. 10 is a schematically illustrated arrangement of the cooling system, showing the direction in which cooling water flows.

As is seen from FIG. 10, the water pump 36 functions to force the cooling water from the suction pipe 34 into the water jackets 12 of the cylinder block 10 through a water inlet passage 36′ (see FIG. 3). The cooling water thus fed into the water jackets 12 flows into the water jackets 16 of the cylinder head 14 through known connecting ports.

Figure 11:
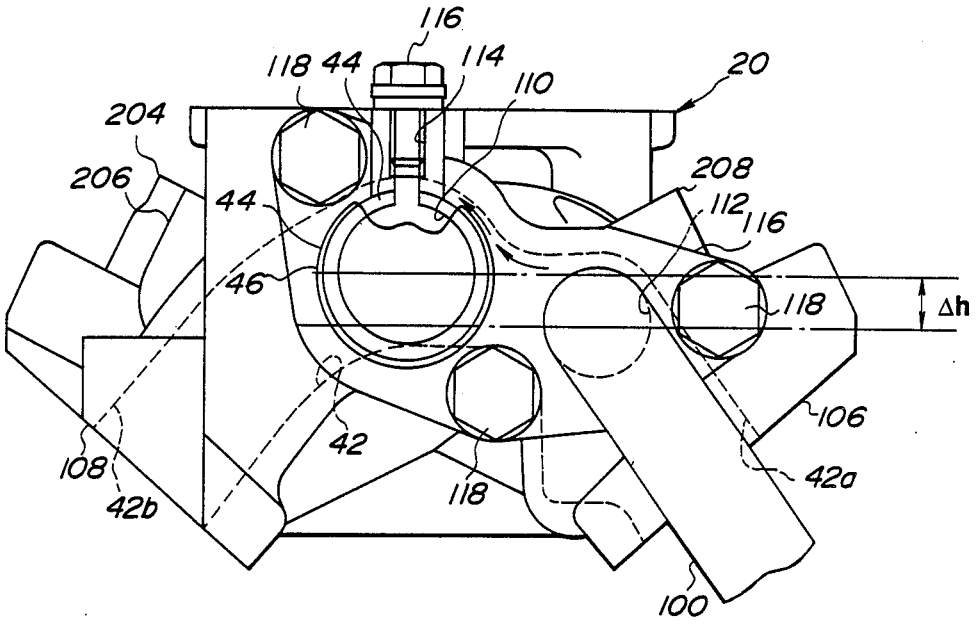
FIG. 11 is a vertically sectioned enlarged view of an intake manifold at a portion where cooling water outlets for a bypass passage and a passenger room heater passage are located.
Figure 12:
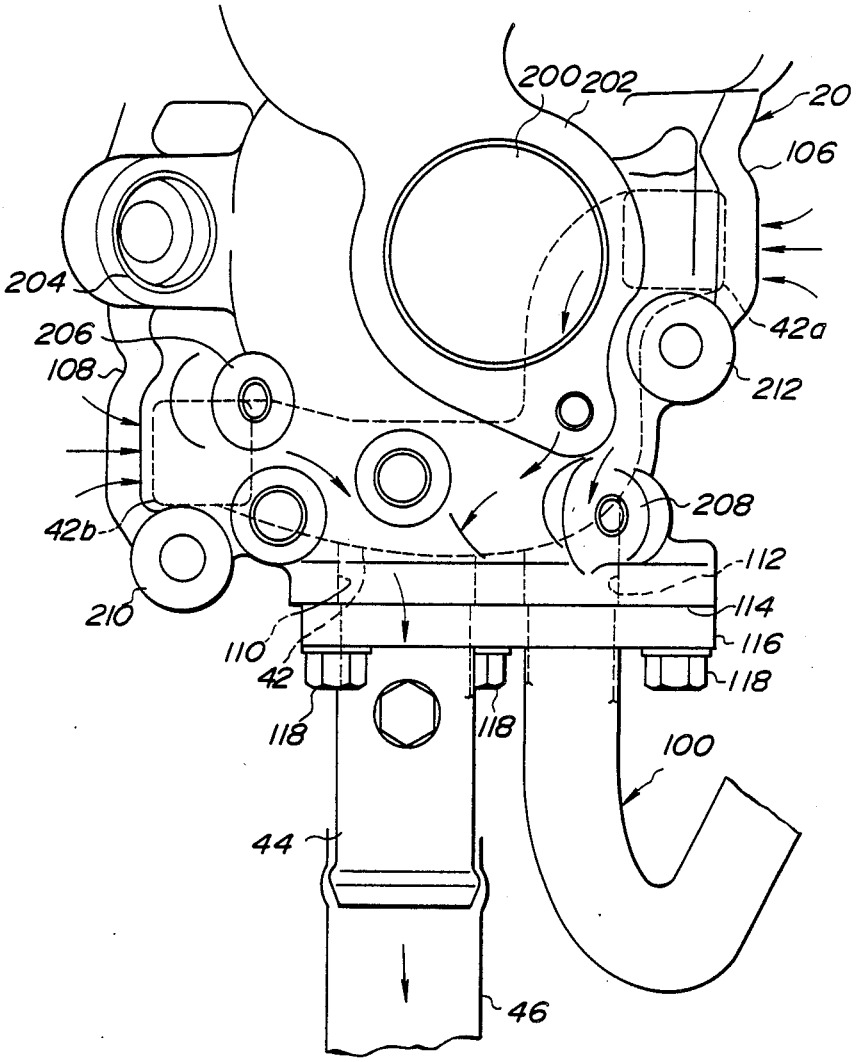
FIG. 12 is a horizontally sectioned enlarged view of the portion of the intake manifold.

As has been mentioned hereinabove, the intake manifold 20 has at its left end portion the second connecting passage 42, which is shown in FIGS. 11 and 12, by which the second water outlet openings of the cylinder heads 14 are joined.

As is seen from FIG. 12, a pipe 44 is connected to the intake manifold 20, which is communicated with the second connecting passage 42. A hose 46 connects the pipe 44 to the second hose connector 30*b* of the thermostat housing 30.

With the parts and constructions mentioned hereinabove, a so-called "normal circulation passage" and a so-called "warm up circulation passage" are provided in the cooling system.

The normal circulation passage comprises the water jackets 12 and 14 of the engine, the first connecting passage of the intake manifold 20, the radiator inlet hose 24, the radiator 26, the radiator outlet hose 28, the thermostat housing 30, the suction pipe 34 and the water pump 36. While, the warm up circulation passage comprises the water jackets 12 and 14 of the engine, the second connecting passage 42, the pipe 44, the hose 46, the thermostat housing 30 and the suction pipe 34. These two circulation passages are selectively operated in response to the operation of the thermostat 32 as will become clarified hereinafter.

Figure 5:
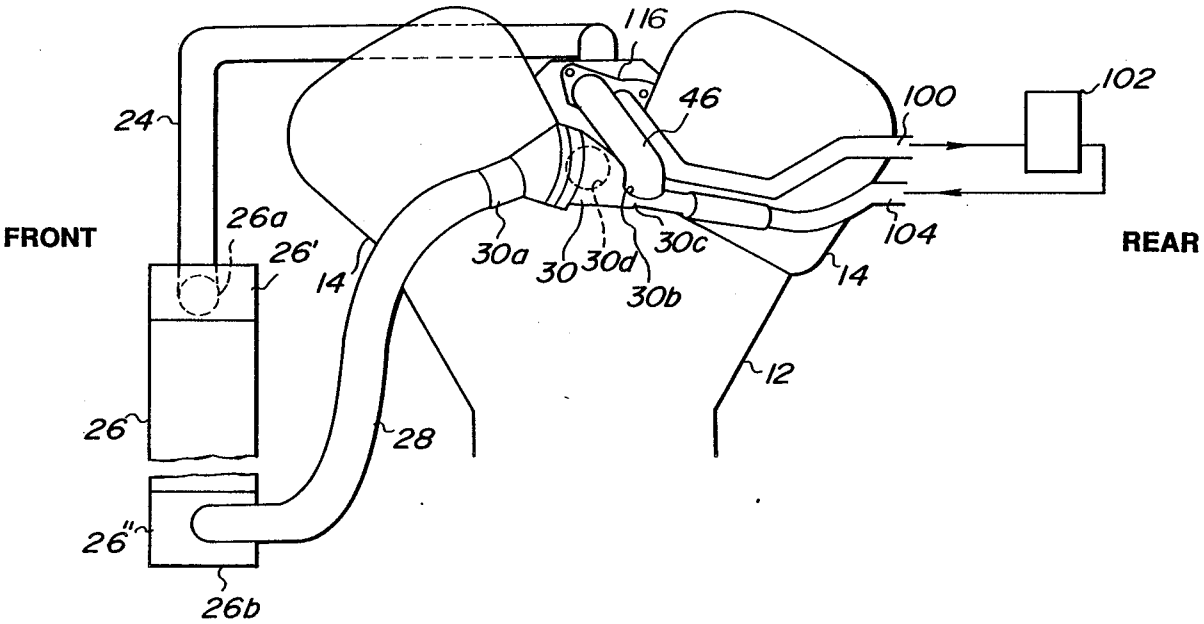
FIG. 5 is a schematic right side view taken from the direction of arrow "V" of FIG. 1.

As will be seen from FIG. 5, a water feeding tube 100 extends from the second connecting passage 42 to a heater core 102 installed in a passenger room. A water return tube 104 extends from the heater core 102 to a third hose connector 30*c* of the thermostat housing 30. Although not shown in the drawing, a valve is installed in the water feeding tube 100 to selectively close and open the same. These parts constitute a so-called "passenger room heating system", whose detailed construction will be described hereinafter.

In the following, operation of the abovementioned cooling system for the engine will be described with reference to FIG. 10 which shows, but schematically, the manner in which the cooling water flows.

When, due to warm up condition of the engine, the thermostat 32 closes the passage (viz., the opening exposed to the first hose connector 30*a*) for the radiator 26 while opening the warm up circulation passage (viz., the opening exposed to the second hose connector 30*b*), the cooling water from the second connecting passage 42 is permitted to flow back directly toward the intake port of the water pump 36 through a bypass passage which includes the pipe 44, the hose 46, the interior of the thermostat housing 30 and the suction pipe 34. That is, under this condition, the cooling water flows in a direction as is indicated by the shorter arrows in FIG. 10. During this, the normal flow of the cooling water through the radiator 26 is suppressed. Thus, the engine warm up is promoted.

While, when, upon completion of the engine warm up, the thermostat 32 opens the passage for the radiator 26 while closing the warm up circulation passage, the direct return of the cooling water to the water pump 36 is suppressed and a flow of the cooling water through the normal circulation passage is permitted to effectively cool the engine by the work of the radiator 26. That is, under this condition, the cooling water flows in a direction as is indicated by the longer arrows.

When, upon requirement of heating the passenger room, the valve in the water feeding tube 100 is opened, the water from the second connecting passage 42 is permitted to flow through the water feeding tube 100, the heater core 102 and the water return tube 104, as is indicated by the dotted line arrows. With this, heat exchange is carried out by the heater core 102 to warm the passenger room.

As will be understood from the above description, in the arrangement of cooling system of the present invention, the inlet and outlet hoses 24 and 28 for the radiator 26 are permitted to extend neatly from the longitudinally opposed ends of the engine. Thus, the drawbacks encountered in the afore-mentioned prior art cooling system arrangement are eliminated.

In the following, the detailed construction of the passenger room heating system will be described with reference to the drawings, particularly, FIGS. 11, 12 an 13.

As is seen from FIGS. 11 and 12, the second connecting passage 42 of the intake manifold 20 has at its opposed ends respective flanged openings 42*a* and 42*b* into which the cooling water from the second water outlet openings of the cylinder heads 14 is introduced. The flanges of the openings 42*a* and 42*b* are denoted by numerals 106 and 108 respectively. Denoted by numeral 200 in FIG. 12 is one of air intake bores of the intake manifold 20, and 202 is a flange of the air intake bore 200. Denoted by numeral 204 is a mount portion for mounting a fuel injector and denoted by numerals 206, 208, 210 and 212 are bossed portions on which fuel feeding pipes are mounted.

As will be seen from FIG. 11, the openings 42*a* and 42*b* are positioned at the same height with respect to the engine construction, but, as will be seen from FIG. 12, the openings 42*a* and 42*b* are somewhat offset with respect to a horizontal plane.

The manner in which the pipe 44 for the warm up circulation passage and the water feeding tube 100 for the passenger room heating system are connected to the second connecting passage 42 is as follows.

As is understood from FIGS. 12 and 13, the intake manifold 20 has at the left end portion thereof a flanged portion 114 in which two openings 110 and 112 exposed to the second connecting passage 42 are formed. A separate flange 116 is secured to the flanged portion 114 by means of three bolts 118. The flange 116 has the above-mentioned pipe 44 and the water feeding tube 100 welded thereto. Upon proper bolting of the flange 116 to the flanged portion 114, the pipe 44 and the water feeding tube 100 are communicated with the openings 110 and 112 respectively.

As is seen from FIG. 11, the second connecting passage 42 is shaped like an arch having a middle portion thereof raised. In the illustrated embodiment, the passage 42 is so shaped that the top of it is located at the substantially the middle position between the two cylinder heads 14.

As is understood from FIG. 11, the opening 110 for the warm up circulation passage is exposed to the top of the arch-shaped second connecting passage 42, and the opening 112 for the passenger room heating system is exposed to the passage 42 at a position which is lower than the top by a certain degree "$\Delta h$".

A vertical bore 114 is formed in the intake manifold 20, which extends upward from the top of the second connecting passage 42. The bore 114 is plugged with an air release screw 116.

As is seen from FIG. 2, sensor mounting portions 118 and 120 are formed on the left end of the intake manifold 20, by which respective temperature sensors for the second connecting passage 42 are held.

As is seen from FIG. 13, between the hose connector 22 for the radiator inlet hose 24 and the pump housing 37 for the water pump 36, there extends a thin tube 122 (see FIG. 4) which serves as an air releasing passage. For the connection of the thin tube 122, respective tube connectors 124 and 126 are welded to the hose connector 22 and the pump housing 37.

The operation of the passenger room heating system will be described in the following with reference to the drawings.

When, during operation of the engine, the valve in the water feeding tube 100 is opened, part of the cooling water, which has been warmed in the water jackets 12 and 16, is discharged from the second connecting passage 42 and fed to the heater core 102 through the water feeding tube 100. Thus, the air in the passenger room is warmed by the heater core 102. The water thus releasing heat at the heater core 102 is then returned to the water pump 36 through the water return tube 104, the thermostat housing 30 and the suction pipe 34 for the subsequent circulation thereof. During this circulation, the abovementioned normal circulation passage for the cooling system operates also. That is, the remaining cooling water in the water jackets 12 and 16 is discharged from the first connecting passage (21) and fed to the radiator 26 and returned to the water pump 36 through the radiator outlet hose 28, the thermostat housing 30 and the suction pipe 34.

It is now to be noted that, as will be seen from FIG. 13, the thermostat 32 has a valve portion 32*a* which is formed with a small aperture. With this aperture, the thermostat 32 functions as follows.

That is, even when the normal circulation passage is selected by the thermostat 32, a small flow of the cooling water through the bypass passage (viz., the pipe 44, the hose 46, the interior of the thermostat housing 30 and the suction pipe 34) is permitted.

In the following, an advantage given from the passenger room heating system having the abovementioned arrangement will be described.

The advantage is given from a unique construction which includes the arch-shaped second connecting passage 42, the pipe 44 (or the opening 110) exposed to the top of the passage 42 and the water feeding tube 100 (or the opening 112) exposed to the passage 42 at a position somewhat lower than the top. That is, with this unique construction, any vapor produced in the water jackets 12 and 16 of the engine is prevented from being fed to the heater core 102. As is known, if the vapor is mixed with the water supplied to the heater core 102, not only the heating effeciency of the heater core 102 is lowered, but also unpleasant noises tend to be produced from the heater core 102.

That is, as is known, during operation of the engine, there is produced vapor in the water jackets 12 and 16, and the vapor is forced upward into the second connecting passage 42 as well as the first connectingt passage (21). Since the opening 110 for the warm up circulation passage is exposed to the top of the arch-shaped second connecting passage 42, the vapor led into the passage 42 tends to gather at the opening 110, as is indicated by the arrows in FIG. 11. Since, as has been mentioned hereinabove, there is always a bypass flow of the cooling water through the bypass passage (44, 46) toward the water pump 36, the vapor is instantly carried by the bypass flow toward the intake port of the water pump 36 through the suction pipe 34, as is understood from the solid arrows of FIG. 12. As will be seen from FIG. 13, the vapor led to the intake port of the water pump 36 is led into the hose connector 22 of the intake manifold 20 and then led to the radiator 26 through the radiator inlet hose 24. The vapor led to the radiator 26 is released to the open air through a cap (not shown) of the radiator 26. The cap is equipped with an air release valve.

Thus, the vapor produced in the water jackets 12 and 16 is prevented from being fed to the heater core 102 of the passenger room heating system.

What is claimed is:

1. In an internal combustion engine having a water jacket through which cooling water flows to cool the engine, an arrangement of engine cooling system comprising:

a water pump driven by said engine to force the cooling water supplied thereto to flow into said water jacket, said water pump being positioned at one longitudinal end of the engine;

a thermostat assembly positioned at the other longitudinal end of the engine;

a suction passage for transferring the cooling water from said thermostat assembly to said water pump;

first means defining a first water outlet of said water jacket at a position near said water pump;

second means defining a second water outlet of said water jacket at a position near said thermostat assembly;

a bypass passage extending between said second water outlet and said thermostat assembly;

a radiator located beside said engine having inlet and outlet openings;

an inlet hose connecting said first water outlet to the inlet opening of said radiator; and an outlet hose connecting said outlet opening of said radiator to said thermostat assembly.

2. An arrangment as claimed in claim 1, in which said first means comprises:

means defining a first passage in an intake manifold of said engine, and means defining a first opening of the water jacket in a cylinder head of said engine, said first passage and said first opening being mated.

3. An arrangement as claimed in claim 2, in which said second means comprises:

means defining a second passage in said intake manifold of the engine; and means defining a second opening of the water jacket in the cylinder head of the engine, said second passage and said second opening being mated.

4. An arrangement as claimed in claim 3, in which said thermostat assembly comprises a first inlet means to which said outlet hose is conneted, a second inlet means to which said bypass passage is connected and an outlet means to which said suction passage is connected.

5. An arrangement as claimed in claim 4, in which said thermostat assembly further comprises a temperature sensitive valve means which selectively closes said first and second inlet means.

6. An arrangement as claimed in claim 5, in which said bypass passage comprises a hose which has one end connected to said second passage of said intake manifold and the other end connected to said second inlet means of said thermostat assembly.

7. An arrangement as claimed in claim 1, further comprising a passenger room heating system which comprises:

a water feeding tube having one end exposed to said second water outlet;

a heater core whose inlet opening is connected to the other end of said water feeding tube; and a water return tube which extends from an outlet opening of said heater core to said thermostat assembly.

8. An arrangement as claimed in claim 7, in which said second water outlet has first and second open portions which are respectively connected with said bypass passage and said water feeding tube, said first open portion being positioned higher than said second open portion.

9. An arrangement as claimed in claim 8, further comprising air releasing means which comprises a thin tube which connects said first water jacket with an intake port of said water pump.

10. An arrangement as claimed in claim 9, in which said second water outlet is defined in an intake manifold of the engine and shaped like an arch.

11. An arrangement as claimed in claim 10, in which said bypass passage is exposed to the top of the arch-shaped second water outlet.

12. In a V-type internal combustion engine having a pair of angled units each including a cylinder block bank and a cylinder head, said unit having a water jacket formed therein, an arrangement of engine cooling system which comprises:

an intake manifold arranged between said cylinder heads;

a water pump driven by said engine to force cooling water supplied thereto to flow into said water jackets, said water pump being positioned at one longitudinal end of said engine;

a thermostat assembly positioned at the other longitudinal end of the engine;

a suction passage for transferring the cooling water from said thermostat assembly to said water pump;

first means defining a first passage in said intake manifold, said first passage being communicated with the water jackets of the paired units, said first passage being postioned near said water pump;

second means defining a second passage in said intake manifold, said second passage being communicated with the water jackets of the paired units, said second passage being positioned near said thermostat assembly;

a bypass passage extending between said second passage of the intake manifold and said thermostat assembly;

a radiator located beside said engine and having inlet and outlet openings;

an inlet hose connecting said first passage of said intake manifold to the inlet opening of the radiator; and an outlet hose connecting the outlet opening of the radiator to said thermostat assembly.

13. An arrangement as claimed in claim 12, further comprises a passenger room heating system which comprises:

a water feeding tube having one end exposed to said second passage of said intake manifold;

a heater core whose inlet opening is connected to the other end of said water feeding tube; and a water return tube which extends from an outlet opening of said heater core to said thermostat assembly, wherein said second passage has first and second open portions which are respectively connected with said bypass passage and said water feeding tube, said first open portion being positioned higher than said second open portion.

14. An arrangement as claimed in claim 13, further comprising air releasing means which comprises a thin tube which connects said first passage of said intake manifold with an intake port of said water pump.

15. An arrangement as claimed in claim 14, in which said thermostat assembly comprises:

a housing including a first inlet means to which said outlet hose of said radiator is connected, a second inlet means to which said bypass passage is connected, a third inlet means to which said water return tube of the heater core is connected and an outlet means to which said suction passage is connected; and a temperature sensitive valve means installed in said housing, said valve means being so arranged that when said passenger room heating system is under operation, there is produced a flow of the cooling water through said bypass passage.

* * * * *